United States Patent [19]

Price

[11] 4,187,593

[45] Feb. 12, 1980

[54] YARN TEXTURING AIR JET WITH CYLINDRICAL AND PLANAR BAFFLES

[75] Inventor: Samuel T. Price, Kennett Square, Pa.

[73] Assignee: Enterprise Machine and Development Corporation, New Castle, Del.

[21] Appl. No.: 28,340

[22] Filed: Apr. 9, 1979

[51] Int. Cl.[2] ..... D02G 1/16

[52] U.S. Cl. ..... 28/254; 28/273

[58] Field of Search ..... 28/254, 273

[56] References Cited

U.S. PATENT DOCUMENTS

| | | | |
|---|---|---|---|
| 2,874,444 | 2/1959 | Griset, Jr. | 28/254 |
| 2,874,445 | 2/1959 | Griset, Jr. | 28/254 X |
| 3,881,231 | 5/1975 | Price et al. | 28/254 |
| 4,104,770 | 8/1978 | Massey, Jr. et al. | 28/273 X |
| 4,107,828 | 8/1978 | Uendening, Jr. et al. | 28/254 |
| 4,148,116 | 4/1979 | Price | 28/254 |

*Primary Examiner*—Robert Mackey

*Attorney, Agent, or Firm*—Bell, Seltzer, Park & Gibson

[57] ABSTRACT

The air jet is provided with a first cylindrical baffle (A) and a second planar baffle (B) supported adjacent the exit orifice (30) of the air jet for successive engagement by the yarn (Y) leaving the air jet. The baffles (A) and (B) successively engage and deflect the yarn as well as the air leaving the exit orifice of the air jet so that two different types of treatment are imparted to the yarn by the successive baffles to permit higher operating speeds and to enhance the quality of the textured yarn. The homogeneous quality of the yarn is enhanced and the yarn exhibits a tighter yarn cross-section bundle because the exterior loop surface and the number of periodic balloons are both reduced.

7 Claims, 3 Drawing Figures

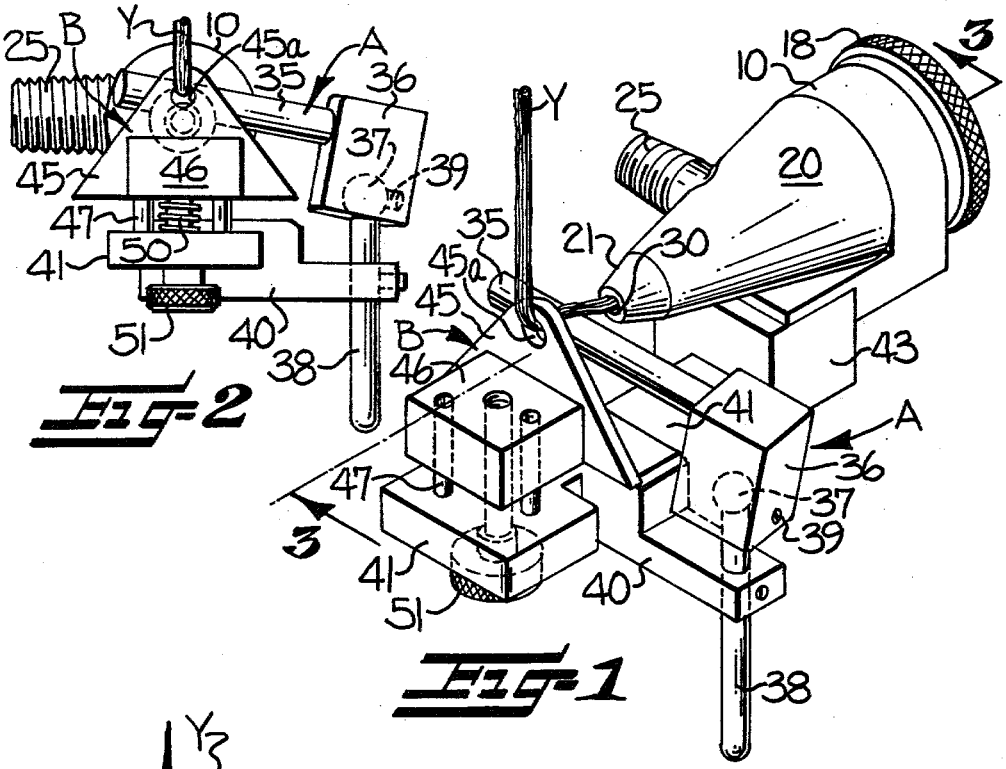
Fig-2
Fig-1
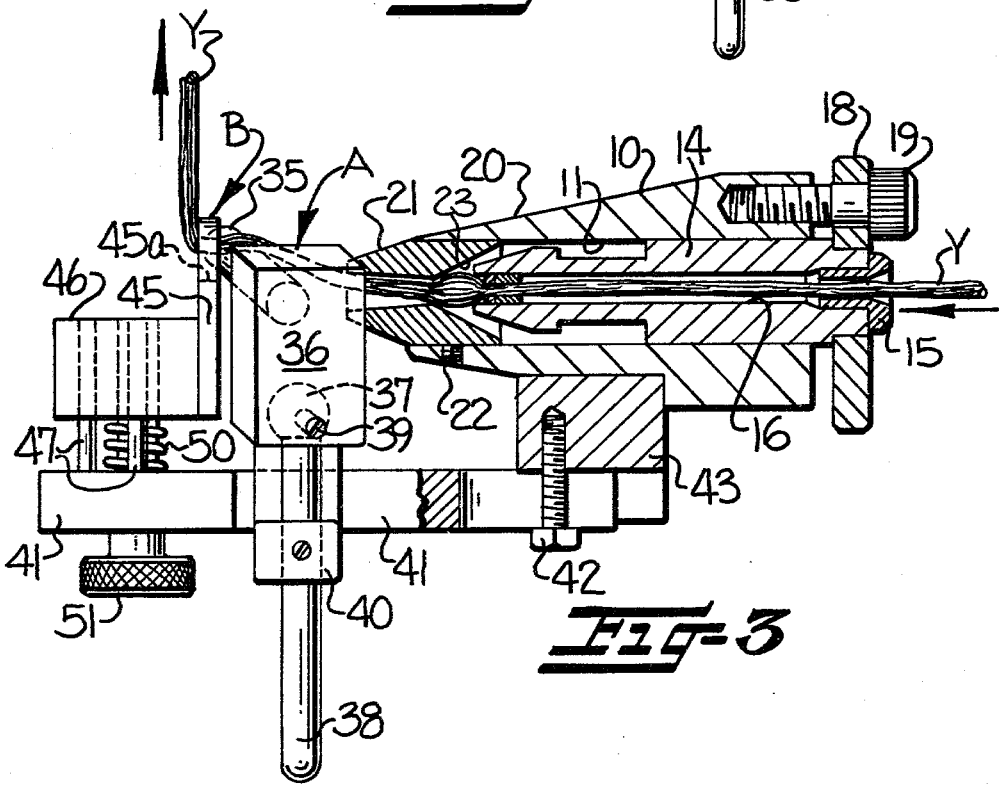
Fig-3

YARN TEXTURING AIR JET WITH CYLINDRICAL AND PLANAR BAFFLES

FIELD OF THE INVENTION

This invention relates generally to a yarn texturing air jet and more particularly to an air jet which includes a first cylindrical baffle and a second planar baffle supported adjacent the exit orifice of the air jet for successive engagement by the yarn leaving the air jet.

BACKGROUND OF THE INVENTION

It is generally known to utilize various types of cylindrical or planar baffles adjacent the exit end of a yarn texturing air jet to permit increased texturing speeds and to enhance the crimps, curls and loops imparted to the yarn in the turbulence chamber of the air jet. These baffles are adapted to be engaged by and deflect the yarn as well as the air leaving the exit orifice of the air jet. My prior U.S. Pat. No. 3,881,231 discloses and describes the advantages of the use of a cylindrical baffle positioned adjacent the exit orifice of a yarn texturing air jet. My copending application Ser. No. 875,396, now U.S. Pat. No. 4,148,116, discloses and describes the advantages of the use of a planar baffle positioned adjacent the exit orifice and including an opening through which the yarn passes. While these and various other types of baffles have been used with yarn texturing air jets, both a cylindrical baffle and a planar baffle have not been used in combination with a single air jet and the results have been limited.

SUMMARY OF THE INVENTION

With the foregoing in mind, it is an object of the present invention to provide a yarn texturing air jet with a first cylindrical baffle and a second planar baffle provided with an opening through which the yarn passes. These two baffles interact on the yarn as well as the air leaving the exit orifice of the air jet so that two different types of treatment are imparted to the yarn. Surprisingly, the successive baffles permit higher operating speeds and enhance the quality of the textured yarn. The homogeneous quality of the yarn is enhanced and the yarn exhibits a tighter yarn cross-section bundle because the exterior loop surface and the number of periodic blooms are both reduced. This enhanced homogeneous quality is achieved while texturing various types of yarn, such as single and continuous filament yarns, parallel construction yarns, and core and effect yarns.

In accordance with the present invention, the first baffle comprises an elongate element, preferably cylindrical, with a longitudinal axis extending across the path of travel of and the surface of the elongate element is engaged by the yarn and air downstream of the exit orifice of the air jet. As the air and yarn pass around the surface of the cylindrical baffle, the change of air flow direction, and the speed and character of the air cause the yarn to "balloon" and then diminish so that the individual yarn filaments are drawn apart to add bulk to the yarn by permitting development of the crunodal loops and then moved back together so that the loops are "locked" together. As the yarn and air engage the second baffle and the yarn passes through the opening in the planar baffle, a shock wave is created and the filaments collapse on themselves and enhance the locked in loops held together by mechanical frictional. As the yarn passes through the opening in the planar baffle, it is directed over and engages an edge of the opening and this edge acts as a twist trap to cause the twist in the filaments introduced by the producer (usually one-half to three-fourths of a turn per inch) to back up along the yarn to further aid in "smoothing" the outer surface of the yarn.

Both the first cylindrical baffle and the second planar baffle are supported for adjustment so that the maximum benefits and advantages of each baffle can be obtained. The adjustment permits the proper positioning of one baffle relative to the other and adjustment of both baffles relative to the exit orifice of the air jet. The baffles are supported for adjustment so that the proper texturing of the yarn can be obtained in view of several different variables, including (but not limited to) air pressure velocity, size of yarn, speed of operation, the type and size of both the cylindrical and planar baffles, and shape, size and type of air jet.

It has been found that the cylindrical and planar baffles operate most efficiently when used with a "bullet nose" type of yarn texturing air jet in which the outer surface of the exit end of the jet tapers inwardly from substantially beyond the midpoint of the jet housing to the exit end portion containing the exit orifice. The amount of inward taper at the exit end of the air jet may be varied and is preferably on the order of about 20 degrees from the longitudinal axis of the jet with the cross-sectional diameter of the terminal end being not substantially greater than about two to three times the cross-sectional diameter of the exit orifice. The outermost portion of the inwardly tapering exit end of the jet is formed by a special venturi which extends outwardly beyond the end of the jet housing and includes a cone-shaped inwardly tapering outer surface which coincides with the adjacent inwardly tapering portion of the jet housing. This inwardly tapering terminal or exit end portion of the air jet facilitates the drawing in or "sucking" in of the surrounding ambient air as the airstream passes outwardly from the exit orifice.

BRIEF DESCRIPTION OF THE DRAWINGS

Other objects and advantages will appear as the description proceeds when taken in connection with the accompanying drawings, in which—

FIG. 1 is an isometric view looking downwardly on a yarn texturing air jet and illustrating the successive baffles of the present invention associated therewith;

FIG. 2 is a front elevational view of the air jet and the associated baffles shown in FIG. 1; and FIG. 3 is an enlarged longitudinal vertical sectional view through the air jet and being taken substantially along the line 3—3 in FIG. 1 but showing the first and second baffles in elevation.

DESCRIPTION OF THE ILLUSTRATED EMBODIMENT

The first and second baffles of the present invention are illustrated and described in association with a particular type of yarn texturing air jet, however, it is to be understood that the present baffles may be utilized in connection with other types of yarn texturing air jets. The air jet includes an elongate housing 10 having a central bore 11 extending therethrough. A yarn guiding needle 14 is positioned for longitudinal sliding movement in the central bore 11 of the housing 10 and the outermost main body portion of the needle 14 is of the same diameter as the central bore 11. The innermost end of the needle 14 is tapered inwardly and extends generally at right angles to the longitudinal axis of the needle to define the entrance end of the turbulence chamber in the air jet housing. The outer end of the needle 14 is provided with a ceramic yarn guide 15 which defines the entrance end of a yarn passage 16 extending along the longitudinal axis of the needle 14.

The yarn guiding needle 14 may be supported for longitudinal adjustment and movement in the central bore 11 in any one of a number of ways and is illustrated as being fixed at its outer end to an adjustment cap 18. Adjustment is provided by a shoulder screw 19 which is threadably supported at its inner end in the entrance end of the housing 10 and passes through a suitable opening in the adjustment cap 18. The shoulder screw 19 may be rotated so that the inner end of the needle 14 is adjusted inwardly or outwardly. Air under pressure is introduced into the central bore 11 through an air pressure inlet 25 and the air pressure entering the bore 11 normally maintains the needle 14 in the outermost position shown in FIG. 3 with the cap 18 against the shoulder screw 19.

The illustrated yarn texturing air jet is of the type which may be referred to as a "bullet nose" jet in which the outer surface of the exit end of the jet tapers inwardly from a position substantially beyond the midpoint of the housing 10 to the terminal or exit end portion of the air jet. Thus, the exit end portion of the air jet housing 10 is substantially cone-shaped, as indicated at 20 in FIG. 1. The outermost portion of the inwardly tapering exit end of the jet is formed by a special venturi 21 which is fixed in the bore 11, as by a set screw 22 (FIG. 3) and includes a cone-shaped inwardly tapering outer surface which substantially coincides with the adjacent inwardly tapering portion of the jet housing 10 and extends outwardly therebeyond. The inner end of the venturi 21 includes an inwardly tapered conical inner wall 23 which defines the exit end of the turbulence chamber in the air jet.

The yarn Y (FIG. 3) enters the air jet through the entrance end, defined by the ceramic yarn guide 15, and passes through the yarn passageway 16 in the needle 14. The longitudinal position of the needle 14 is adjusted so that the pressurized air passing through the inlet 25, enters the central bore 11, passes along the inner end of the needle 14 and into the turbulence chamber through a restricted air flow passageway completely surrounding the inner end of the needle. Crimps, curls and loops are imparted to the yarn Y as it passes through the turbulence chamber, defined by the inner end of the needle 14 and the inwardly tapering conical inner wall 23 of the venturi 21. The yarn Y then passes through the venturi 21 and out of the jet through an exit orifice 30.

The inwardly tapering outer surface of the exit end portion of the air jet facilitates the drawing in or "sucking" in of the surrounding ambient air as the yarn and air pass outwardly from the exit orifice 30, as indicated by the arrows in FIG. 3. The amount of inward taper at the exit end of the air jet may be varied and is preferably on the order of about 20 degrees relative to the longitudinal axis of the air jet with the cross-sectional diameter of the terminal end being not substantially greater than about two to three times the cross-sectional diameter of the exit orifice 30. The air jet is shown in FIG. 3 at a scale larger than actual size. The overall length of the housing 10 is one and three-quarters inches, the venturi 21 extends one-quarter of an inch outwardly from the housing 10, and the diameter of the exit end of the venturi is one-quarter of an inch.

In accordance with the present invention, a first baffle, broadly indicated at A, and a second baffle, broadly indicated at B, are supported adjacent the exit orifice 30 for successive engagement by the yarn Y and the air leaving the air jet. The first and second baffles A, B are provided for enhancing the texturing of the yarn by the air jet and are successively engaged by the yarn downstream of the exit orifice 30.

The first baffle A comprises an elongate element, illustrated as being cylindrical and in the form of a cylinder or rod 35, having a longitudinal axis extending across the path of travel of the yarn Y and the air leaving the exit orifice 30. The upper surface of the cylindrical baffle 35 is engaged by the yarn Y as it passes thereover and downstream of the exit orifice 30 of the air jet. One end of the cylindrical baffle 35 is fixed in a support block 36, forming a portion of first adjustment support means. The first adjustment support means is provided for varying the downstream distance between the first baffle A and the exit orifice 30, for varying the perpendicular position of the first baffle A, and for varying the angular position of the cylindrical baffle 35 extending across the path of travel of the yarn Y from the exit orifice 30 to the second baffle B.

The support block 36 is supported for universal adjustment on an enlarged socket 37 on the upper end of a vertical support rod 38. A set screw 39 is provided in the support block 36 to maintain the cylindrical baffle 35 in the properly adjusted position. The medial portion of the vertical support rod 38 is supported for sliding vertical adjustment in the outer end portion of a support bracket 40. The inner end of the support bracket 40 straddles and is supported for longitudinal adjustment on a medial portion of a support bar 41. The rear end of the support bar 41 is slotted (FIG. 3) and is supported for longitudinal adjustment, as by a screw 42, in a mounting block 43 fixed on the air jet.

Thus, the downstream distance of the first baffle A relative to the exit orifice 30 may be adjusted by longitudinal adjustment of the support bracket 40 along the support bar 41. The perpendicular position of the first baffle A relative to the exit orifice 30 may be adjusted by raising and lowering the vertical support rod 38, and the angular position of the cylindrical baffle 35 across the path of travel of the yarn Y may be varied by changing the angular position of the support block 36 on the socket 37 on the upper end of the vertical support rod 38.

The second baffle B comprises a relatively thin flat planar baffle plate 45. As illustrated in FIGS. 1 and 2, the baffle plate 45 is substantially triangular in elevation and includes an opening **45*a* through which the yarn Y passes after passing over the first baffle A. The lower portion of the outer face of the baffle plate 45 is fixed on one face of an adjustment support block 46, which is supported for vertical movement on guide pins 47, the lower ends of which are fixed in the support bar 41. The block 46 is normally urged to the uppermost position by a compression spring 50, which surrounds the medial portion of an adjustment screw 51. The adjustment screw 51 penetrates the support bar 41 and its upper end threadably penetrates the adjustment support block 46**.

Thus, second adjustment support means is provided for the second baffle B to vary the downstream distance between the second baffle B and the first baffle A and to vary the perpendicular position of the second baffle B relative to the exit orifice 30 of the air jet. To vary the downstream distance between the second baffle B and the first baffle A, the screw 42 is loosened and the support bar 41 is moved longitudinally to position the baffle B the desired distance from the exit orifice 30. The perpendicular position of the second baffle B can be varied by rotating the adjustment screw 51 to raise or lower the baffle B and thereby change the position of the opening 45*a*, through which the yarn Y passes.

In operation, the yarn Y passes through the air jet and is textured in the usual manner with the individual filaments being crimped, curled and looped in the turbulence chamber, between the inner end of the needle 14 and the inwardly tapering inner end 23 of the venturi 21. As the textured yarn Y and air leave the exit orifice 30, the yarn Y and the air engage and pass over the cylindrical baffle 35 where the yarn is subjected to one type of treatment. The yarn then passes through the opening 45*a* in the second baffle B and is directed upwardly along the outer planar face to engage the upper edge of the opening 45*a*. The air, which passes over the cylindrical baffle 35, engages the inner planar face of the baffle plate 45 and a shock wave effect is created as at least some of the air passes through the opening 45*a* so that the yarn is subjected to a second type of treatment.

It is not completely understood how the two baffles operate to enhance the quality of the textured yarn. However, it is believed that the yarn and air passing over the cylindrical baffle causes an air foil effect to be created above the cylindrical baffle 35 so that the yarn tends to balloon and then diminish. The individual yarn filaments are drawn apart as the yarn balloons to permit development of the crunodal loops and then the filaments are drawn back together as the yarn diminishes to lock the looped filaments together. As the yarn passes through the shock wave, set up at the inner face of the baffle B, and passes through the opening 45*a* and over the edge in the planar baffle plate 45, the filaments are again agitated and drawn together to enhance the locked in loops as they are held together by mechanical friction. The edge of the opening 45*a* in the baffle B is also believed to act as a twist trap to cause the twist in the filaments introduced by the producer (usually one-half to three-fourths of a turn per inch) to back up along the yarn and further aid in smoothing the outer surface of the yarn.

In the embodiment illustrated, the yarn Y passes over the cylindrical baffle 35 while supported in substantially a horizontal position, however, the yarn Y can be passed under the cylindrical baffle 35 and, with the proper adjustment of the cylindrical baffle, the desired enhancement of the textured yarn can be obtained. Also, the cylindrical baffle 35 can be supported in substantially a vertical position and the yarn passed around either side.

The illustrated embodiment includes a single cylindrical baffle and a single planar baffle. However, it is to be understood that more than one cylindrical baffle and/or more than one planar baffle can be supported for adjustable or fixed positioning for engagement with the yarn after leaving the air jet. Also, one or more additional or auxiliary yarns may be guided into and merge with the yarn leaving the air jet so that the additional yarn will be subjected to the texturizing capabilities of the baffle arrangement without being processed through the air jet.

In the drawings and specification, there has been set forth a preferred embodiment of the invention, and although specific terms are employed, they are used in a generic and descriptive sense only and not for purposes of limitation.

I claim:

1. In a yarn texturing air jet of the type including an elongate housing having a central bore therethrough, an entrance end for passage of multifilament yarn into said air jet, an exit orifice for passage of yarn from said air jet, and means for directing pressurized air into the central bore of said housing to contact the yarn and pass outwardly through the exit end of said air jet to impart crimps, curls and loops to the filaments as the yarn passes through said air jet; the combination therewith of first and second baffles for enhancing the texturing of the yarn by said air jet, said first and second baffles being supported adjacent said exit orifice for successive engagement by the yarn and air leaving said air jet, said first baffle comprising an elongate element with a longitudinal axis extending across the path of travel of and being engaged by the yarn downstream of said exit orifice of said air jet, said second baffle comprising a relatively thin flat baffle plate positioned downstream of said first baffle and substantially perpendicular to the path of travel of the yarn, and said baffle plate including an opening through which the yarn passes after leaving said first baffle.

2. A yarn texturing air jet according to claim 1 wherein said elongate housing includes an outer surface tapering inwardly from substantially beyond the midpoint of said housing to the terminal end portion containing said exit orifice, and wherein the cross-sectional diameter of said terminal end is not substantially greater than three times the cross-sectional diameter of said exit orifice to facilitate the flow of air inwardly and downwardly around the terminal end of said elongate housing.

3. A yarn texturing air jet according to claims 1 or 2 wherein said elongate element defining said first baffle is cylindrical, at least in that portion engaged by the yarn downstream of said exit orifice.

4. A yarn texturing air jet according to claim 1 including first adjustment support means for varying the downstream distance between said first baffle and said exit orifice of said air jet and for varying the perpendicular position of said first baffle relative to said exit orifice of said air jet.

5. A yarn texturing air jet according to claim 4 wherein said first adjustment support means also includes means for varying the angular position of said elongate element relative to the path of travel of the yarn from said exit orifice to said second baffle.

6. A yarn texturing air jet according to claims 4 or 5 including second adjustment support means for supporting said second baffle to vary the downstream distance between said second baffle and said first baffle and for varying the perpendicular position of said second baffle relative to said exit orifice of said air jet.

7. A yarn texturing air jet according to claim 1 wherein the yarn is directed upwardly after passing through said opening in said baffle plate so that the yarn engages and is drawn across the upper edge of said opening.

* * * * *